US008955581B2

(12) United States Patent
Minnich

(10) Patent No.: US 8,955,581 B2
(45) Date of Patent: Feb. 17, 2015

(54) METHOD AND SYSTEM FOR RECOVERING OIL AND GENERATING STEAM FROM PRODUCED WATER

(71) Applicant: Back Porch Holdings Inc., Calgary (CA)

(72) Inventor: Keith R. Minnich, Calgary (CA)

(73) Assignee: Back Porch Holdings, Inc., Calgary, Alberta (CA)

( * ) Notice: Subject to any disclaimer, the term of this patent is extended or adjusted under 35 U.S.C. 154(b) by 0 days.

(21) Appl. No.: 14/277,899

(22) Filed: May 15, 2014

(65) Prior Publication Data

US 2014/0245973 A1 Sep. 4, 2014

Related U.S. Application Data

(62) Division of application No. 12/702,004, filed on Feb. 8, 2010, now Pat. No. 8,746,336.

(60) Provisional application No. 61/150,598, filed on Feb. 6, 2009.

(51) Int. Cl.

| | |
|---|---|
| ***E21B 43/24*** | (2006.01) |
| ***E21B 36/00*** | (2006.01) |
| ***F22B 1/08*** | (2006.01) |
| ***E21B 43/34*** | (2006.01) |
| ***F22B 29/02*** | (2006.01) |
| ***F22B 37/26*** | (2006.01) |

(52) U.S. Cl.

CPC . *F22B 1/08* (2013.01); *E21B 43/24* (2013.01); *E21B 43/34* (2013.01); *F22B 29/02* (2013.01); *F22B 37/26* (2013.01)

USPC ..... 166/61; 166/303; 166/272.3

(58) Field of Classification Search

USPC ..... 166/61, 272.3, 266, 267, 303; 122/209.1; 203/22, 26

See application file for complete search history.

(56) References Cited

U.S. PATENT DOCUMENTS

| | | | | |
|---|---|---|---|---|
| 3,527,290 | A * | 9/1970 | Lossing | 165/70 |
| 4,474,011 | A * | 10/1984 | Nelson et al. | 60/648 |
| 4,747,449 | A * | 5/1988 | Nickell | 165/134.1 |
| 4,967,837 | A * | 11/1990 | Danzik | 166/270.1 |
| 6,019,070 | A * | 2/2000 | Duffy | 122/209.1 |
| 7,428,926 | B2 * | 9/2008 | Heins | 166/266 |
| 2006/0032630 | A1 * | 2/2006 | Heins | 166/266 |
| 2007/0095759 | A1 * | 5/2007 | Bridle | 210/687 |
| 2010/0200231 | A1 * | 8/2010 | Minnich | 166/272.3 |
| 2010/0224364 | A1 * | 9/2010 | Heins | 166/267 |

* cited by examiner

*Primary Examiner* — Daniel P Stephenson

(74) *Attorney, Agent, or Firm* — LeClairRyan, a Professional Corporation

(57) ABSTRACT

A method of recovering oil from an oil well and producing steam for injection into an injection well is provided. After recovering an oil-water mixture from the oil well, oil is separated from the mixture to produce an oil product and produced water. In one process, the produced water is directed to an indirect fired steam generator which is powered by an independent boiler or steam generator. As water moves through the indirect fired steam generator, the same is heated to produce a steam-water mixture. The steam-water mixture is directed to the steam separator which separates the steam-water mixture into steam and water. The separated water is directed from the steam separator back to and through the indirect fired steam generator. This separated water is continued to be recycled through the indirect fired steam generator. Steam separated by the steam separator is directed into the injection well.

14 Claims, 4 Drawing Sheets

METHOD AND SYSTEM FOR RECOVERING OIL AND GENERATING STEAM FROM PRODUCED WATER

This application is a divisional of U.S. patent application Ser. No. 12/702,004 filed Feb. 8, 2010, and claims priority under 35 U.S.C. §119(e) from the following U.S. provisional application: Application Ser. No. 61/150,598 filed on Feb. 6, 2009. Both the aforementioned applications are incorporated by reference in their entirety.

BACKGROUND

Oil producers utilize different means to produce steam for injection into the oil bearing formation. The steam that is injected into the geologic formation condenses by direct contact heat exchange, thus heating the oil and reducing its viscosity. The condensed steam and oil are collected in the producing well and pumped to the surface. This oil/water mixture, once the oil has been separated from it, is what is referred to as 'produced water' in the oil industry.

Since water can comprise up to 90% of every barrel of oil/water mixture removed from the formation, the recovery and reuse of the water is necessary to control the cost of the operation and to minimize the environmental impact of consuming raw fresh water and subsequently generating wastewater for disposal. Once the decision to recover water is made, then treatment of those produced waters is required to reduce the scaling and/or organic fouling tendency of the water. This treatment generally requires the removal of the hardness and other ions present in the stream, preferably to near zero. As is understood in the art, the 'hardness' causing ions are the combined calcium and magnesium salts in the water to be used in steam generation equipment and is typically expressed as parts per million (ppm) although other terms can be used. While silica is not considered as adding to the hardness value, its presence can also lead to scaling problems if present in other than minimal amounts.

The traditional method for generation of steam in enhanced oil recovery is to utilize a once-through steam generator (OTSG) in which steam is generated from a treated feedwater through tubes heated by gas or oil burners. The OTSG feedwater can have a total dissolved solids concentration as high as 8,000 ppm, but requires a hardness level that is 0.5 ppm (as $CaCO_3$) or less. This method produces a low quality or wet steam, which is approximately 80% vapor and 20% liquid, at pressures ranging from 250 pounds per square inch gauge (psig) up to 2400 psig. This 80% quality steam either directly injected into the formation or in same cases the 80% vapor is separated from the 20% water and then the vapor is injected into the formation. Either a portion or all of the 20% blowdown is disposed as a wastewater.

Another method that has been used to obtain the high quality steam requirement is using a water tube boiler instead of the OTSG to generate steam. The water tube boiler, however, requires an even greater amount of feedwater pretreatment than the OTSG to ensure problem free operation. The lime soda softening, media filter, and polishing WAC are replaced by a mechanical vapor compressor evaporator (MVC). A very large electrical infrastructure is required to supply power to the MVC evaporator compressors and power consumption is high due to MVC evaporator compressor. The concentrate from the evaporator in the case of high pH operation is difficult to process, requiring expensive crystallizers and dryers or expensive offsite disposal.

SUMMARY

The present invention provides a novel high pressure steam generation method and apparatus for produced water that eliminates the need for once through steam generators and power consuming vapor compressors.

The present invention includes a system and process where produced water from an oil recovery process is heated by various heat sources and then directed into a steam separator that separates the water from the steam. The separated water from the steam separator is directed through one or more coiled pipes that extend through one or more containment vessels or chambers that form a part of an indirect fired steam generator. Steam for heating the water in the coiled pipes is generated in a fired boiler, such as a water tube boiler, and the generated steam is directed into the containment vessel where the steam, which is held in the containment vessel, heats the water passing through the coiled pipes. This essentially heats at least some of the water passing through the coiled pipes to produce a steam-water mixture that is directed back to a steam separator. This process is continuous and is effective to produce approximately 98%-100% quality steam.

The apparatus is capable of operating at high pressures and can be economically fabricated and cleaned using conventional pipe "pigging" equipment.

In a process for producing high pressure steam vapor, deoiled produced water that has a quality similar to that of OTSG feedwater is used as feedwater for an indirect fired steam generator (IFSG). The IFSG is an apparatus that provides an economic and robust method to produce high pressure steam. The IFSG consists of a number of vessels that typically have one heat transfer pipe in a containment vessel. Each pipe follows a serpentine path, forming a coil, inside each containment, vessel so that the amount of heat transfer coil in each containment vessel is maximized (See FIGS. 2 and 3). Multiple vessels can be joined in parallel to form a bank. Multiple banks can be joined to form a grouping. The desired steam generation capacity is achieved by optimizing the number of banks and groups.

The preferred design used in the present invention provides a produced water steam generation plant that overcomes a number of problems.

First, the problem prone low efficiency once through steam generators for high pressure steam production using treated produced water is no longer required.

Second, the pretreatment requirements of the produced water, prior to high pressure steam generation, are minimized. Sludge streams associated with warm lime softening are eliminated.

Third, the process as disclosed herein, is steam driven and there is no requirement for high energy consuming mechanical vapor compressors or electrical infrastructure.

Fourth, controlled levels of multivalent cations, combined with controlled levels of silica, substantially eliminates the precipitation of scale forming compounds associated with sulfate, carbonate, or silicate anions. Thus, cleaning requirements are minimized. This is important commercially because it enables a water treatment plant to avoid lost water production, which would otherwise undesirably require increased treatment plant size to accommodate for the lost production during cleaning cycles.

Fifth, the apparatus can be cleaned by "pigging", which is commonly used for OTSGs.

Sixth, another benefit to the IFSG operation is the use of industry accepted water tube boilers, the feed to which is not organic laden treated produced water.

Seventh, if OTSGs are used to generate the steam required to drive the IFSG, the OTSGs are operated using feedwater that meets the guidelines of the various national and international standards.

Finally, the IFSG steam generation process has the benefits of a very high brine recirculation rate to evaporation rate ratio, which results in better heat transfer surface wetting, and a lower temperature difference combined with a lower unit heat transfer rate across the heat transfer surface than an OTSG operating on the same produced water. The result is a better design with less scaling potential and higher allowable concentration factors.

Other objects and advantages of the present invention will become apparent and obvious from a study of the following description and the accompanying drawings which are merely illustrative of such invention.

DETAILED DESCRIPTION

The invention disclosed herein provides an integrated process and apparatus for generating high pressure steam from produced water in heavy oil recovery operations. The energy that would normally only be used once to generate injection steam is used twice in this process. The first use of the energy is the generation of steam from high purity water in a direct fired water tube boiler. The second use is the generation of injection steam from produced water. The generation of injection steam from produced water is accomplished by utilizing a high pressure, high efficiency IFSG process. This overcomes the disadvantages of the low efficiency OTSG, the requirements for treating the full produced water feed stream to near ASME quality standards for water tube boilers, and high power consumption by the MVC installations. When incorporated with the zero liquid discharge (ZLD) in one embodiment, recoveries greater than 98% of the produced water feed stream may be attainable at a cost effective price with no liquid streams requiring disposal.

Both the IFSG 84 and the watertube boiler 110 are operated in environments that they are well suited for; i.e. a high total dissolved solids (TDS) tubular steam generator with "pigging" capability coupled with a high pressure high purity ASME feedwater grade watertube boiler or OTSG. This leads to equipment reliability and reduced costs. The cost reductions can be broken down into lower operating costs, since there is no requirement for mechanical vapor compressors, and lower water pretreatment capital costs, since there is not a requirement for extensive water conditioning associated with changing produced water into ASME quality water.

Figure 1:
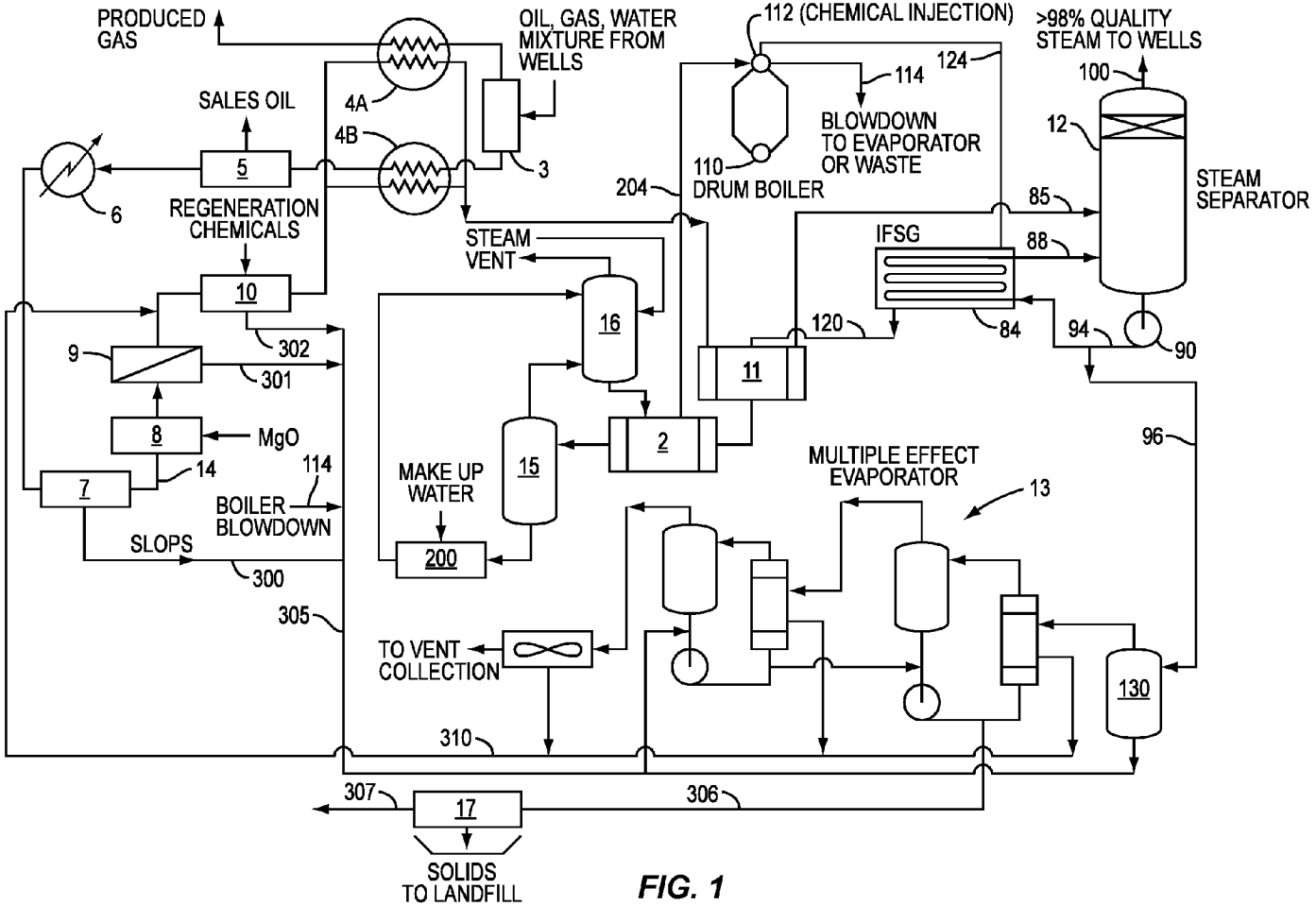
FIG. 1 is a schematic diagram that shows the use of the IFSG process.

With reference to FIG. 1 a mixture of oil, water, and gases is recovered from a production well. The mixture of oil and water is generally referred to as the emulsion. The temperature of this mixture is usually above 160° C.

The gases are separated from emulsion liquids in a group separator 3. The gases from the group separator 3 are cooled in heat exchanger 4A and the emulsion liquids are cooled in heat exchanger 4B. The cooled gas becomes produced gas. The cooled liquids, which are a mixture of oil and water, are transferred to free water knockout (FWKO) 5.

The free water knockout 5 separates substantially all of the free oil from the emulsion. The separated oil becomes sales oil. The remaining liquid, which is water with between 50 ppm and 1,000 ppm of free oil is referred to as produced water. The produced water is further cooled in glycol cooler 6.

Virtually all of the remaining free oil is removed from the produced water in deoiling equipment 7 and becomes slops stream 300 which is directed to stream 305 which transfers waste to multiple effect evaporator 13. Details of the multiple effect evaporator 13 are not dealt with here in detail. For a detailed and unified understanding of the multiple effect evaporator and how the same is used in purification processes, one is directed to U.S. Pat. No. 7,578,345, the disclosure of which is expressly incorporated herein by reference.

Produced water stream 14 will typically contain soluble and insoluble organic and inorganic components. The inorganic components can be salts such as sodium chloride, sodium sulfate, calcium chloride, calcium carbonate, calcium phosphate, barium chloride, barium sulfate, and other like compounds. Metals such as copper, nickel, lead, zinc, arsenic, iron, cobalt, cadmium, strontium, magnesium, boron, chromium, and the like may also be included. Organic components are typically dissolved and emulsified hydrocarbons such as benzene, toluene, phenol, and the like.

Produced waters utilized for production of steam additionally include the presence of silicon dioxide (also known as silica or SiO2) in one form or another, depending upon pH and the other species present in the water.

For steam generation systems, scaling of the heat transfer surface with silica is to be avoided. This is because: (a) silica forms a relatively hard scale that reduces productivity heat transfer equipment, (b) it is usually rather difficult to remove, (c) the scale removal process produces undesirable quantities of spent cleaning chemicals, and (d) cleaning cycles result in undesirable and unproductive off-line periods for the equipment. Therefore, regardless of the level of silica in the incoming raw feed water, silica is normally removed.

The deoiled produced water 14 is transferred to sorption reactor 8. Magnesium oxide (MgO) is added to sorption reactor 8. The magnesium oxide hydrates to magnesium hydroxide. All but a few tens of ppm of the silica in the produced water is sorbed onto the magnesium hydroxide crystals. The magnesium hydroxide crystals with sorbed silica are removed in ceramic membrane 9. The reject from ceramic membrane 9 is stream 301 and contains virtually all the crystals that were formed in the sorption reactor 8. Stream 301 is directed to stream 305 which transfers waste streams to multiple effect evaporator 13.

Permeate from the ceramic membrane is treated by ion exchange 10 to remove multi-valent cations. These cations include, but are not limited to, calcium, magnesium, lithium, and barium. The ion exchange processes include but are not limited to weak acid cation (WAC), strong acid cation (SAC), or combinations of WAC and SAC.

It is noted that silica removal can be avoided by operating the IFSG at a lower conversion of water to steam and taking a higher blowdown flow from the steam separator or by adding a silica scale inhibitor. Ion exchange would still be used to prevent hardness based scales. More frequent chemical cleaning and/or pigging may be required in this embodiment to remove soft silica scales from the IFSG.

The treated produced water from the ion exchange process is heated against the oil emulsion from the wells in heat exchanger 4B and gas that has been separated from the emulsion in heat exchanger 4A. This step recovers heat that would otherwise be wasted.

After heating by the emulsion and produced gas the treated produced water is further heated by condensate cooler 11 to approximately the saturation temperature corresponding to the desired pressure of the steam at the outlet of the steam separator 12. This heating is accomplished using the condensed steam from the IFSG group 84. The pre-heated produced water stream 85 is then discharged into the steam separator 12 where it is mixed with the steam-water mixture from the IFSG group 84. The steam separator 12 separates the steam-water mixture into steam and water.

A recirculation pump 90 transfers the separated water from the outlet of steam separator 12 to the inlet of the IFSG group 84. The water flow to the IFSG group can be approximately 5 times the desired amount of steam that is generated in the IFSG group. This water is distributed between banks of IFSGs so that there is approximately even flow in each coil.

Figure 2:
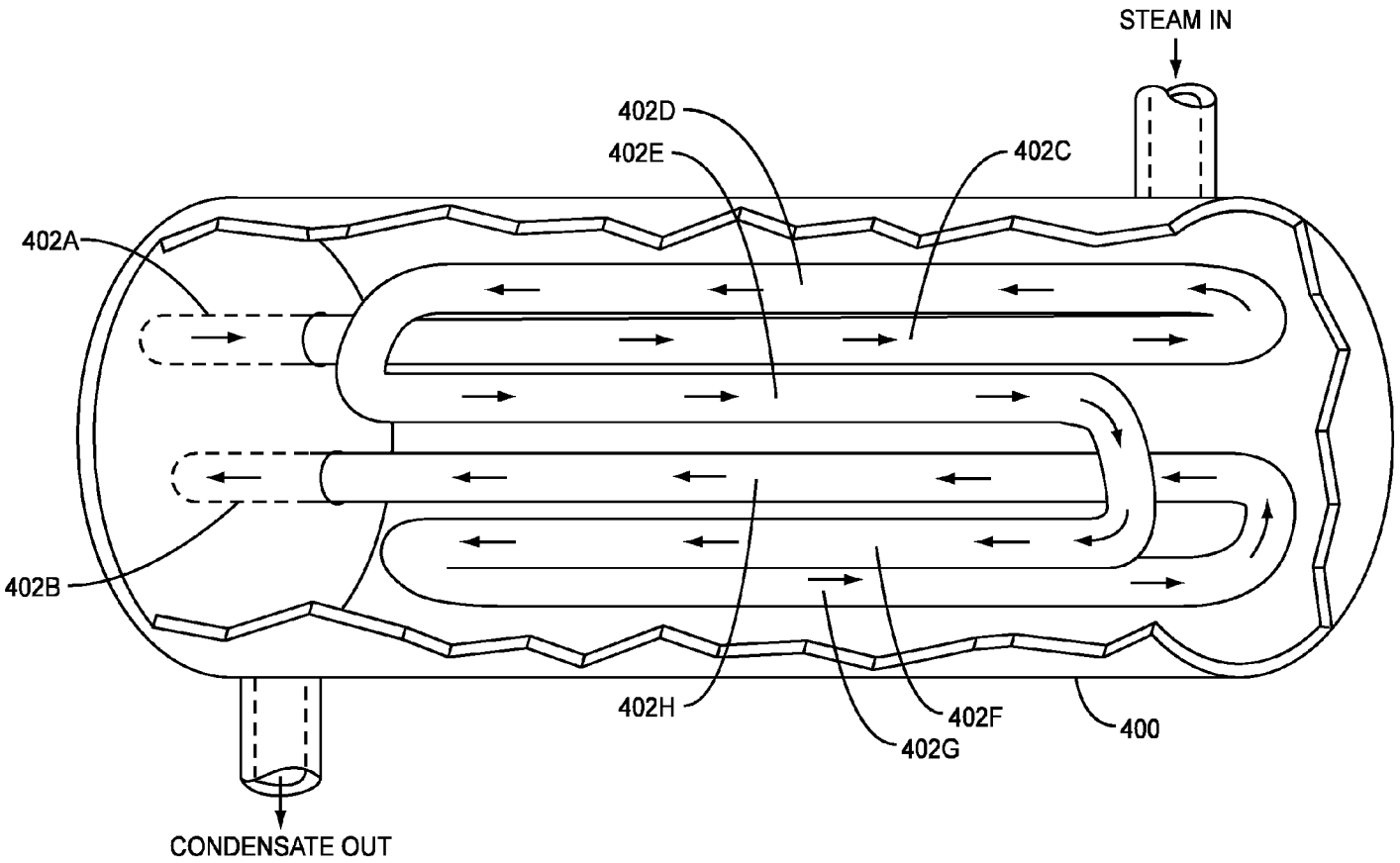
FIG. 2 is a perspective view of an IFSG with portions broken away to better illustrate the heating tubes of the IFSG.

Before discussing the process further, it may be beneficial to briefly review the structure of the ISFG 84. Basically the ISFG 84 includes one or more containment vessels 400 as schematically illustrated in FIG. 2. The length of a containment vessel is typically between 40 feet and 120 feet. Each containment vessel 400 includes a pipe or tube segment 402. The length of the tube segment in one embodiment is typically between 200 feet and 1200 feet. In one embodiment, the pipe segment 402 assumes a serpentine configuration within the containment vessel 400 and as such includes elongated sections that turn and wind back and forth throughout the containment vessel 400. FIG. 2 illustrates an example of a pipe segment 402. Note that the pipe segment includes an inlet 402A and an outlet 402B. In addition, the same pipe segment includes a plurality of runs. In the case of the exemplary embodiment shown herein, the pipe segment includes six runs, 402C, 402D, 402E, 402F, 402G and 402H. It should be appreciated that the number of runs could vary depending on the application and the capacity of the process. The pipe segment and its respective runs are supported within the containment vessel 400. Typically an internal frame structure is provided interiorly of the containment vessel 400 and the frame structure engages and supports the pipe segment and the runs that make up the pipe segment.

In the embodiment illustrated herein, the containment vessel is an elongated cylinder. The length of a containment vessel is typically between 40 feet and 120 feet. However it should be appreciated that the shape and size of the containment vessel 400 can vary. In one exemplary embodiment, the containment vessel 400 includes an outside diameter of approximately 24 inches and is constructed of schedule 80 pipe, which can a have typical length between 200 feet and 1200 feet. In the same example, the diameter of the internal pipe or tube segment is on the order of approximately 4 inches and can also be constructed of schedule 80 pipe. Again, the size and capacity of the containment vessel 400 and the pipe segments can vary.

Figure 3:
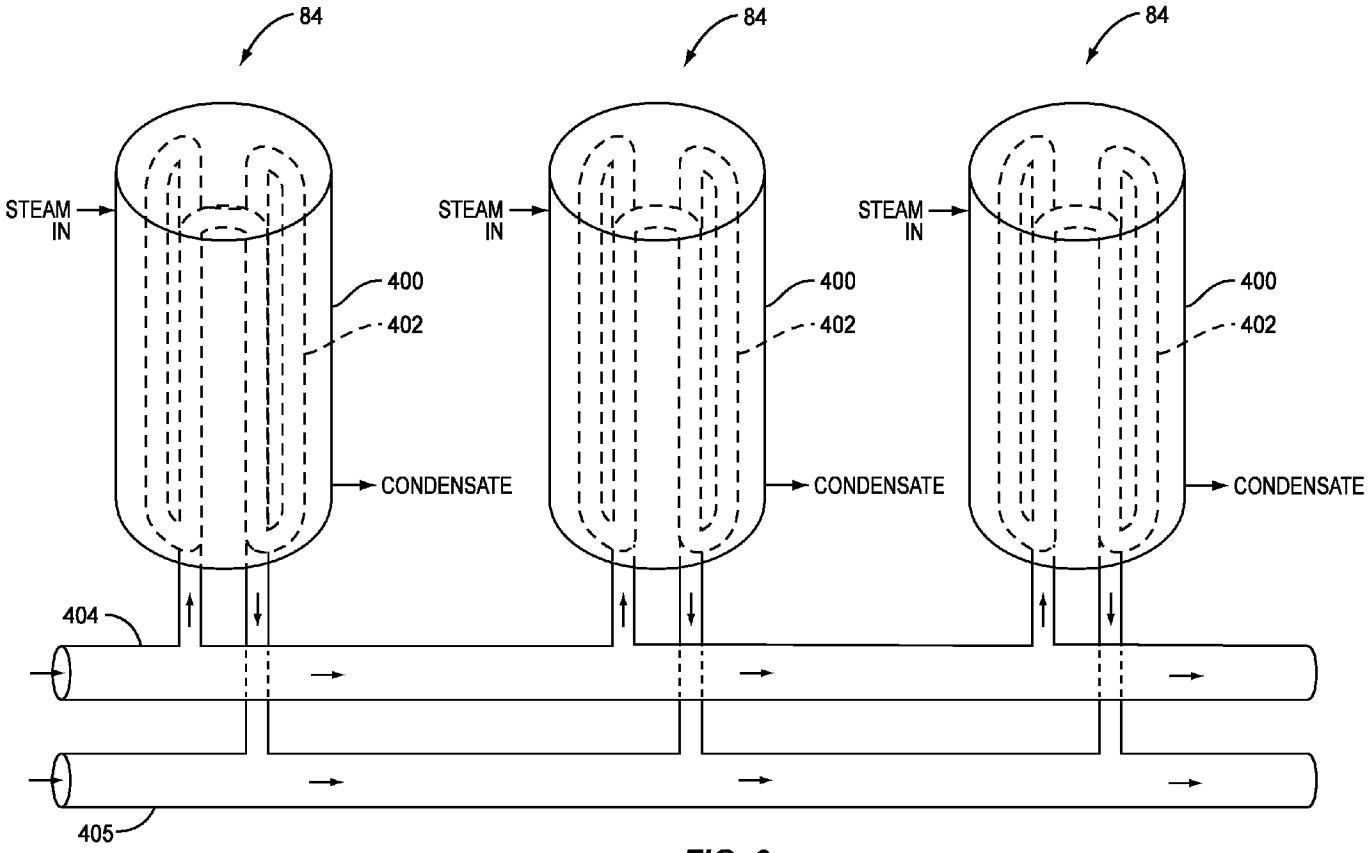
FIG. 3 is an illustration showing a bank of IFSGs interconnected.

FIG. 2 schematically illustrates the inlet and outlets 402A and 402B of a pipe segment associated with a single containment vessel 400. FIG. 3 shows a bank of containment vessels 400 connected by one or more manifolds 404 and 405. As seen in FIG. 3, manifold 404 is operative to direct produced water into the inlet of the respective indirect fired steam generators 84. Manifold 405 is operatively connected to the outlet of the respective indirect fired steam generators 84. This enables the steam-water mixture in the respective indirect fired steam generators 84 to be directed through the outlets thereof and to the manifold 405. Once in the manifold 405 the steam-water mixture is directed to the steam separator 12, or in an alternative design, the steam-water mixture could be directed to the injection well. It should be appreciated that individual containment vessels 400 can be banked together and then if desired, the individual banks can be operatively interconnected to form groups. This provides an efficient and cost effective design for applications requiring multiple containment vessels 400.

The temperatures and pressures within the containment vessel 400 and within the pipe segments can vary. In one exemplary embodiment, it is contemplated that the temperature within the containment vessel 400 outside of the pipe segment would be approximately 600° F. and that the pressure within the containment vessel, outside of the pipe segment, would be approximately 1500 psig. Then inside the pipe segments it is contemplated that the temperature would, in one example, be approximately 520° F. and the pressure would be approximately 800 psig.

Steam from a water tube drum boiler 110 is directed to the containment vessels in the IFSG group 84 and condenses on the outside of the coil or pipe segments. The latent heat of vaporization transfers through the wall of the pipe and into the mixture inside the pipe, thereby raising the temperature of the mixture. At the high temperature and pressure in the pipe a small increase in temperature causes a large increase in pressure and the mixture quickly reaches its bubble point. After the bubble point is reached the heat transferred from the condensing steam on the outside of the pipe boils water from the mixture inside the coil. The two phase mixture of steam and water exits the IFSG group 84 through stream 88 and then enters steam separator 12. Various types of boilers can be utilized to produce steam that is utilized by the IFSG group 84. In one example, the boiler may include a heat recovery steam generator which could be heated by a combustion turbine exhaust. In this example, the combustion turbine is connected to an electrical generator.

The vapor in stream 88 is separated in steam separator 12 and becomes 98% or higher quality steam. This steam at the high pressure necessary for injection, and typically with less than 10 ppm of non-volatile solutes, is routed through line 100 directly to the steam injection wells.

In the steam separator 12, the liquid from stream 88 mixes with the treated and conditioned produced water stream 85. Stream 85 dilutes the concentrated high solids stream present in line 88. Stream 94 is recirculated with high pressure recirculation pump 90. A portion of stream 94 is removed as IFSG blowdown through line 96. Stream 96 contains the solutes that were present in stream 85.

A commercial watertube drum boiler 110 operating on high quality ASME rated feed water supplies the high pressure steam 124 that is required to drive the high pressure high efficiency IFSG 84. The high pressure steam 124 transfers heat by condensing on the outside of the pipe of the IFSG 84. The condensing steam descends by gravity to the bottom of the containment vessel 400 and is collected as condensate stream 120. Condensate stream 120 is used to preheat treated and conditioned produced water in condensate cooler 11.

The condensate from condensate cooler 11 is further cooled in boiler feed water heater 2 before flashing to slightly above atmospheric pressure in Flash Tank 15. The cooled condensate is purified in condensate polisher Ion exchange 200. Make-up water is added to condensate polisher ion exchange 200 to replace boiler blowdown 114. After deaeration in deaerator 16 the purified condensate is then returned via line 204 to the commercial watertube boiler 110 wherein energy is supplied and the condensate is returned to steam.

A small boiler blowdown stream represented by line 114 is taken from the watertube boiler 110, and directed to either waste or, in one embodiment, to an evaporator through line 305 for recovery. The blowdown stream 114 is necessary to prevent buildup of total dissolved solids (TDS) in the boiler 110 and is typically less than 2.5% of the boiler capacity.

Makeup water for the watertube boiler 110 can be supplied by any of various means of producing deionized water. As depicted in FIG. 1, the makeup is supplied through line 204 by a condensate polishing unit 200. The condensate polishing system can be of various types to remove solutes from both the condensate stream 120 and from the make-up water source, such as well water. Under these circumstances, the unit 200 provides high quality ASME grade water, which along with a high pressure boiler chemical program 112, generally ensures trouble free operation of the watertube boiler 110. In other embodiments, the condensate polishing unit 200 can be replaced with a reverse osmosis system or a combination of reverse osmosis and ion exchange to provide the ASME quality water required by watertube boiler 110.

The steam separator blowdown stream 96 is flashed in flash tank 130. The flash steam is used to drive a multiple effect evaporator 13 to maximize water recovery and waste disposal requirements. Some of the dissolved salts will precipitate in the multiple effect evaporator 13. Additional suspended material will be present in streams 300 and 301. These solids are removed from the evaporator concentrate 306 in centrifuge 17. The centrate 307 from centrifuge 17 can be disposed in a deep well or further processed in a zero liquid discharge system. The combined distillate 310 from multiple effect evaporator 13 is returned to the produced water line downstream of ceramic membrane 9.

The just described IFSG process produces a high quality steam at pressures dependent on the individual site designs, typically ranging from 200 to 900 psig, which satisfies the near 100% quality steam requirement needed for SAGD operation at a cost reduction when compared to OTSG and MVC processes.

Figure 1A:
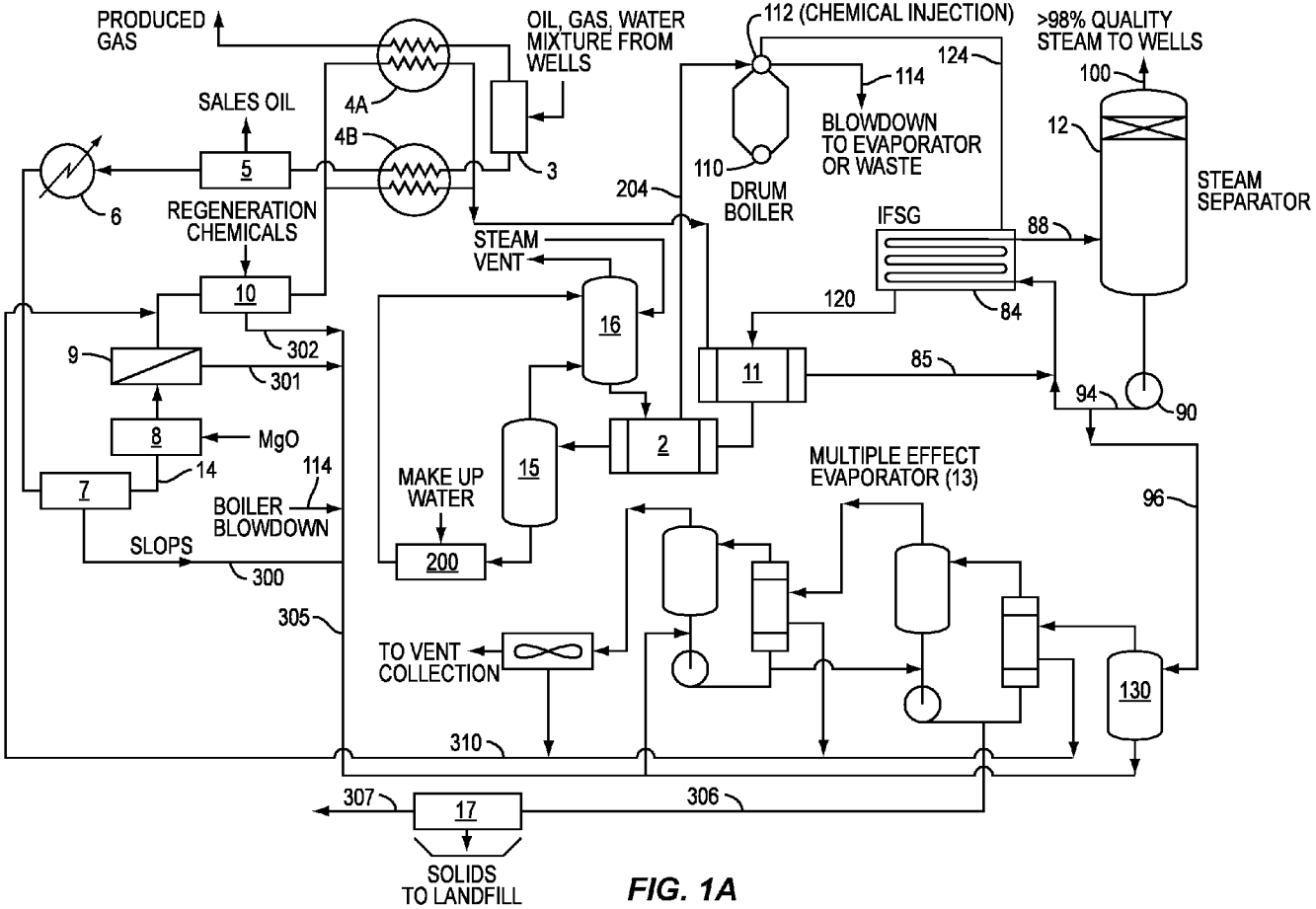
FIG. 1A is a schematic diagram showing an alternative process using the IFSG process.

FIG. 1A depicts a process similar to that shown in FIG. 1 and described above. The basic differences between the processes of FIGS. 1 and 1A lie in how the produced water stream 85 is ultimately directed to the steam separator 12 and IFSG 84. In the process of FIG. 1 the produced water stream 85 is directed initially into the steam separator 12. At least a portion of that produced water is returned through line 94 to the IFSG where the water passing through the IFSG is heated and converted to a steam-water mixture.

In the embodiment depicted in FIG. 1A, the produced water stream 85 is first directed to the IFSG 84. As shown in FIG. 1A, produced water leaving the condensate cooler 11 is directed in stream 85 to the inlet of IFSG 84. As shown in FIG. 1A the produced water stream 85 joins the separated water return stream 94 and both streams are directed through the IFSG where the water is heated and converted to a steam-water mixture. As noted above, some of the produced water in stream 85 will eventually be separated by the steam separator 12 and recycled back to the IFSG via line 94.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed:

1. An indirect fired steam generator comprising:

a containment structure having a length of approximately 80 feet to approximately 1200 feet and having a surrounding wall structure that defines an interior space for receiving and holding a heating medium under pressure;

a network of one or more elongated heating tubes extending back and forth through the interior of the containment structure and wherein there is provided an open space between the network of heating tubes and the surrounding wall structure of the containment structure such that the heating tubes are configured such that when the containment structure holds the heating medium the network of heating tubes extend back and forth through the heating medium held within the containment structure;

wherein the network of heating tubes includes an inlet for receiving water and an outlet for directing a heating medium-water mixture from the indirect fired steam generator; and further wherein the indirect fired steam generator forms one of a bank of indirect fired steam generators with each indirect fired steam generator of the bank including at least one network of heating tubes; and wherein the network of heating tubes disposed in the indirect fired steam generators are operatively interconnected such that water or a heating medium-water mixture flows from an input manifold into each of the indirect fired steam generators and the water or heating medium-water mixture therein is heated in the indirect fired steam generators as the water or heating medium-water mixture flows through the respective networks of heating tubes; and wherein the outlet from each indirect fired steam generator is operatively connected to a collection manifold.

2. The indirect fired steam generator of claim 1 wherein the network of heating tubes includes a plurality of runs where each run extends between opposite ends of the containment structure.

3. The indirect fired steam generator of claim 1 wherein the network of elongated heating tubes includes a heating tube having an inlet and an outlet and wherein the heating tube has a length of approximately 200 feet to approximately 1200 feet and includes multiple runs such that the multiple runs of the heating tube zigzags back and forth through the containment structure.

4. The indirect fired steam generator of claim 1 wherein the containment structure comprises an elongated cylinder and wherein the network of heating tubes includes a plurality of heating tube segments where each heating tube segment assumes a generally cylindrical shape.

5. The indirect fired steam generator of claim 4 wherein the diameter of the cylindrical containment structure is approximately 4 to 5 times larger than the diameter of the respective heating tube segments that extend through the cylindrically shaped containment structure.

6. The indirect fired steam generator of claim 1 wherein the indirect fired steam generator comprises a containment vessel with the one or more heating tubes extending within the containment vessel; and wherein the temperature within the containment vessel outside of the one or more heating tubes is approximately 460° F. to 660° F. and wherein the pressure within the containment vessel outside of the one or more heating tubes is approximately 450 psig to approximately 2350 psig.

7. The indirect fired steam generator of claim 1 wherein the indirect fired steam generator comprises a containment vessel with the one or more heating tubes extending within the containment vessel; and wherein the temperature within the heating tubes is approximately 400° F. to approximately 600° F. and the pressure inside the one or more heating tubes is approximately 250 psig to approximately 1500 psig.

8. The indirect fired steam generator of claim 1 wherein at least one heating tube extending through the containment structure includes a plurality of generally straight tube segments interconnected by generally curve-shaped tube segments.

9. The indirect fired steam generator of claim 1 including means for mechanically removing deposits from the interior of the one or more heating tubes in the containment structure.

10. The indirect fired steam generator of claim 9 where the means for mechanically removing deposits is pigging.

11. The indirect fired steam generator of claim 1 wherein the heating tubes include a diameter of approximately four inches.

12. The indirect fired steam generator of claim 1 wherein the water is produced water.

13. The indirect fired steam generator of claim 12 wherein silica has been removed from the produced water.

14. The indirect fired steam generator of claim 1 wherein the heating medium is steam.

* * * * *